US007703622B1

(12) United States Patent
Bynoe

(10) Patent No.: US 7,703,622 B1
(45) Date of Patent: Apr. 27, 2010

(54) COMPARTMENTALIZED TRASH AND RECYCLABLE CONTAINER

(76) Inventor: Margaret Bynoe, 2525 SE. Hemsing St., Port St. Lucie, FL (US) 34984

( * ) Notice: Subject to any disclaimer, the term of this patent is extended or adjusted under 35 U.S.C. 154(b) by 1184 days.

(21) Appl. No.: 11/042,658

(22) Filed: Jan. 25, 2005

(51) Int. Cl.
*B65D 43/26* (2006.01)

(52) U.S. Cl. ..... 220/263; 220/908; 220/262; 220/524; 220/826

(58) Field of Classification Search ..... 220/524, 220/909, 908, 913, 262, 263, 23.88, 260, 220/810, 826, 523, 264, 495.09
See application file for complete search history.

(56) References Cited

U.S. PATENT DOCUMENTS

| | | | | | |
|---|---|---|---|---|---|
| 1,848,331 | A * | 3/1932 | Esslinger | 220/553 |
| 4,042,142 | A * | 8/1977 | Ruano | 220/4.21 |
| 5,005,727 | A * | 4/1991 | Roth | 220/495.09 |
| 5,170,904 | A * | 12/1992 | Neuhaus | 220/262 |
| 5,662,235 | A * | 9/1997 | Nieto | 220/23.86 |
| 5,706,971 | A * | 1/1998 | Taylor | 220/523 |
| 6,386,386 | B1 * | 5/2002 | George | 220/526 |
| 6,626,317 | B2 * | 9/2003 | Pfiefer et al. | 220/263 |
| 6,837,393 | B1 * | 1/2005 | Kuo | 220/263 |
| 7,108,148 | B2 * | 9/2006 | Lu | 220/263 |
| 7,290,674 | B1 * | 11/2007 | Ledford | 220/507 |
| 2003/0178800 | A1 * | 9/2003 | Fite | 280/47.38 |
| 2005/0284870 | A1 * | 12/2005 | Yang et al. | 220/495.09 |

* cited by examiner

*Primary Examiner*—Anthony Stashick
*Assistant Examiner*—Christopher B McKinley
(74) *Attorney, Agent, or Firm*—Michael I Kroll

(57) ABSTRACT

Apparatus 10 discloses a compartmentalized waste and recyclable container 12. The compartmentalized container 12 is comprised of a divided waste container having removable receptacles 24, 26. One receptacle is designed for holding normal waste 26 while the other is designed for holding recyclables 24, such as cans, jars, plastic bottles, etc. The waste container has a sectioned lid 16, 17 providing access to either or both containers. The apparatus 10 also provides means whereby the container can be opened by a foot-operated mechanism 14, 15, relieving the user of having to have a free hand for access. Additionally, the container can incorporate wheels 18 for mobility and apertures 20 within the exterior wall. Each of the interior removable receptacles 24, 26 can also have handles 22 mounted thereto for ease of removing and carrying.

6 Claims, 13 Drawing Sheets

COMPARTMENTALIZED TRASH AND RECYCLABLE CONTAINER

BACKGROUND OF THE INVENTION

1. Field of the Invention

The present invention relates generally to waste receptacles and, more specifically, to a compartmentalized waste and recyclable container. The compartmentalized container is comprised of a divided waste container having removable receptacles. One receptacle is designed for holding normal waste while the other is designed for holding recyclables, such as cans, jars, plastic bottles, etc. The waste container has a sectioned lid providing access to either or both containers. The present invention also provides means whereby the container can be opened by a foot operated mechanism, relieving the user of having to have a free hand for access. Additionally, the container can incorporate wheels for mobility and apertures within the exterior wall. Each of the interior removable receptacles can also have handles mounted thereto for ease of removing and carrying.

2. Description of the Prior Art

There are other receptacles designed for recyclables. Typical of these is U.S. Pat. No. 4,878,592 issued to Lee on Nov. 7, 1989.

Another patent was issued to Haas, et al. on Sep. 10, 1991 as U.S. Pat. No. 5,046,635. Yet another U.S. Pat. No. 5,111,958 was issued to Witthoeft on May 12, 1992 and still yet another was issued on Mar. 9, 1999 to (NAME) as U.S. Pat. No. 5,878,904.

A refuse collection apparatus for segregation of recyclable materials and the like includes an outer container body which receives a plurality of inner complimentary receptacle units. Each receptacle unit includes recessed handle members at the upper edge thereof to facilitate removal from the outer container and a lower handle portion at the opposite end of the unit for convenient carrying and dumping of the unit. In one embodiment, a wire support frame is fitted within the rim of the outer container body to support lip portions of the receptacle units. In another embodiment, a receptacle tray is provided to rest within the container body on the receptacle units for collecting stackable recyclable materials such as newspaper, while only partially covering the access openings to the receptacle units for permitting deposit of refuse therein without removing the tray. In a third embodiment a partition wall divides the interior container area into two collection chambers, one being provided with receptacle units and a tray for segregated recyclable collection while the other is utilizable for non-recyclable collection. A pivoted cover for the recyclable chamber enables automated inversion and dumping of the other chamber.

An improved trash separator container is provided and consists of a housing having a closed bottom wall and an open top. A first mechanism is within the housing, for dividing the housing into multiple compartments to separately store different types of trash items which are to be recycled therefrom. A top cover fits over the open top of the housing. A second mechanism is in said top cover, for gaining access into each of the compartments so as to deposit the different types of trash items into the compartments. A third mechanism is connected to the closed bottom wall of the housing, for rotating the housing latitudinally along its axis when placed upon a flat surface so that one portion of the access mechanism will always face a person, allowing the person to deposit the trash items into one of the selective compartments.

A refuse collection unit for household use comprising a container body defining a first storage area adapted to receive at least a conventional plastic refuse bag therein and a second storage area adapted to receive at least two removable rigid liners in a side-by-side disposition therein. The removable liners are each used to store a particular type of recyclable refuse material therein, and the conventional plastic refuse bag for storage of nonrecyclable refuse. The liners include a bottom wall, three liner walls and an upwardly stepped fourth wall. Hand-gripping elements are provided on each of said liners. The first storage area rises higher than the second storage area for easy recognition of the areas. In addition, a pair of hinged cover members are provided, one for the first storage area and the other for the second storage area. A third liner may be placed in the first storage area to occupy substantially one-half of said first storage area.

An apparatus for dividing a trash can into a plurality of separate compartments for separating and storing recyclable materials. The plurality of separate compartments are formed by placing a plurality of insertable dividers into the trash can. The dividers combine to define an aperture in the center of the trash can opening to a lower volume of the trash can, permitting the disposal of metal cans or some other material into the lower volume.

While these receptacles may be suitable for the purposes for which they were designed, they would not be as suitable for the purposes of the present invention, as hereinafter described.

SUMMARY OF THE PRESENT INVENTION

The present invention discloses a compartmentalized waste and recyclable container. The compartmentalized container is comprised of a divided waste container having removable receptacles. One receptacle is designed for holding normal waste while the other is designed for holding recyclables, such as cans, jars, plastic bottles, etc. The waste container has a sectioned lid providing access to either or both containers. The present invention also provides means whereby the container can be opened by a foot-operated mechanism relieving the user of having to have a free hand for access. Additionally, the container can incorporate wheels for mobility and apertures within the exterior wall. Each of the interior removable receptacles can also have handles mounted thereto for ease of removing and carrying.

A primary object of the present invention is to provide a trash container that can be used for both trash and recyclables.

Another object of the present invention is to provide a trash container having an exterior housing with a first and second container positioned therein.

Yet another object of the present invention is to provide a trash container having a lid providing access to one or both interior containers.

Still yet another object of the present invention is to provide a trash container wherein said interior containers are separable and removable.

Another object of the present invention is to provide a trash container having wheels positioned on the base for mobility.

Yet another object of the present invention is to provide a trash container having foot operated mechanism in communication with a respective lid.

Still yet another object of the present invention is to provide a trash container having an exterior housing with aperture positioned within the exterior wall.

Additional objects of the present invention will appear as the description proceeds.

The present invention overcomes the shortcomings of the prior art by providing a compartmentalized waste and recyclable container. The compartmentalized container is comprised of a divided waste container having removable receptacles. One receptacle is designed for holding normal waste while the other is designed for holding recyclables, such as cans, jars, plastic bottles, etc. The waste container has a sectioned lid providing access to either or both containers. The present invention also provides means whereby the container can be opened by a foot operated mechanism, relieving the user of having to have a free hand for access. Additionally, the container can incorporate wheels for mobility and apertures within the exterior wall. Each of the interior removable receptacles can also have handles mounted thereto for ease of removing and carrying.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
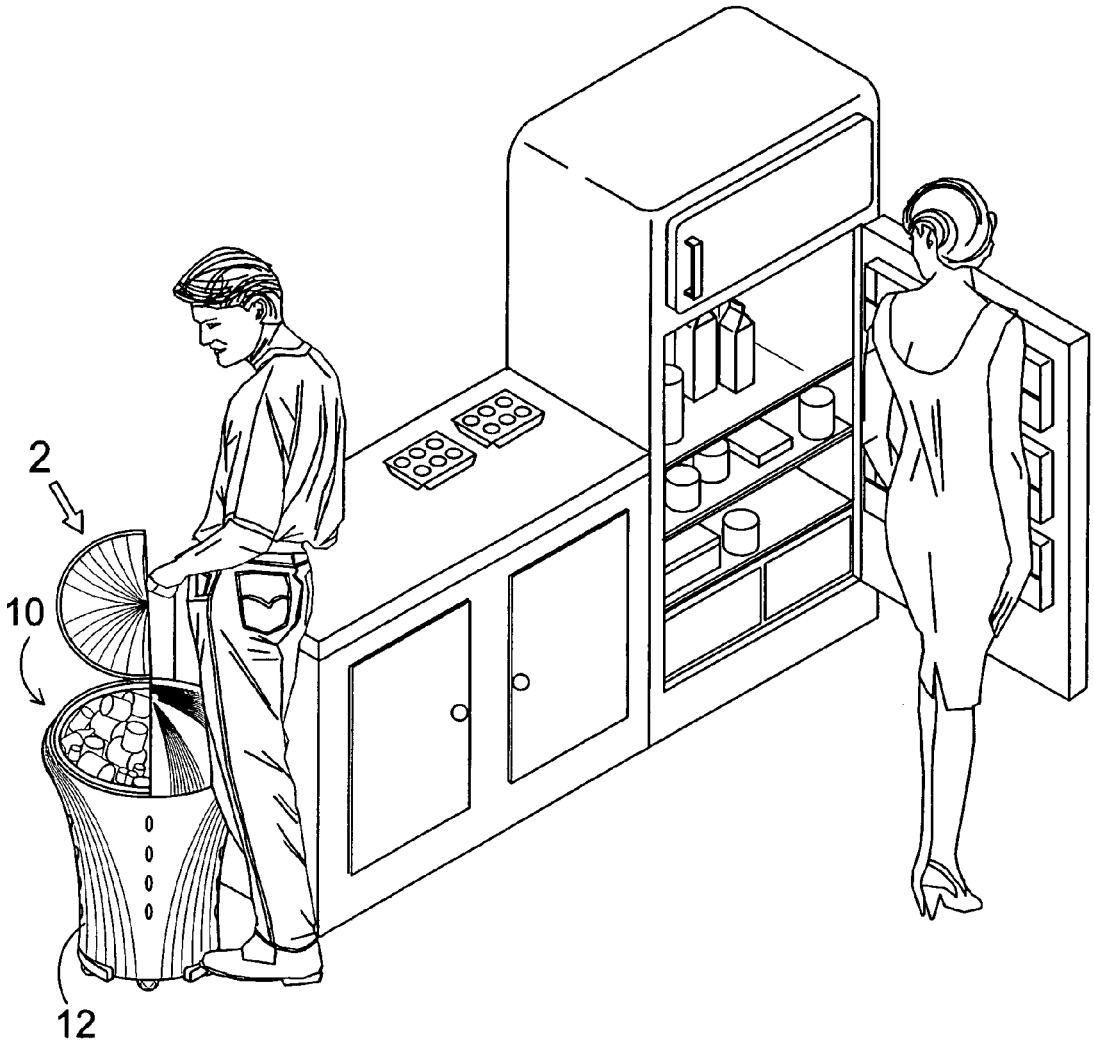
FIG. 1 is an illustrative view of the present invention.

With regard to reference numerals used, the following numbering is used throughout the drawings.

10 present invention
12 housing
14 left lever
15 right lever
16 left lid
17 right lid
18 wheel
20 vent holes
22 handle
24 recycle container
26 trash
28 left side lift assembly
30 right side lift assembly
32 cable guide
34 cable
36 lever pivot point/hinge
38 foot lever

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10. The present invention 10 provides a refuse collection device. Two removable containers with the outer housing 12 are used to sort recyclable materials and trash. Either container can be lined with common trash can liners. The outer housing 12 can be in a variety of colors and patterns.

Figure 2:
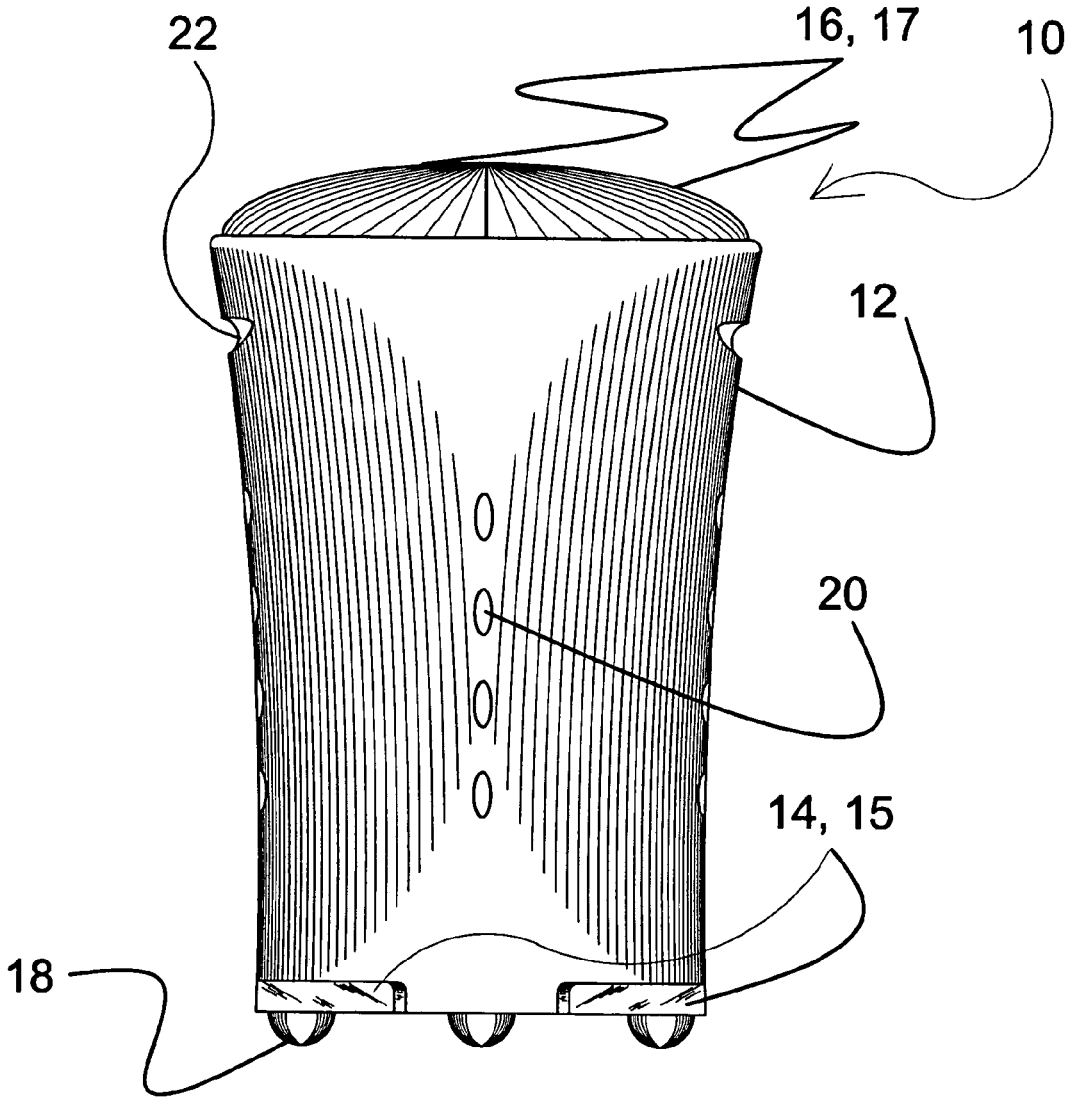
FIG. 2 is a front view of the present invention.

Turning to FIG. 2 shown therein is a front view of the present invention 10. The cylindrical housing 12 retains the two removable containers, one for trash and one for recyclable materials. Foot levers 14, 15 located at the base of the cylindrical housing 12 control the motion of raising the lids 16, 17 for either side of the housing. The housing 12 is provided with roller type wheels or casters 18. Also shown are vent holes 20 and embedded handles 22.

Figure 3:
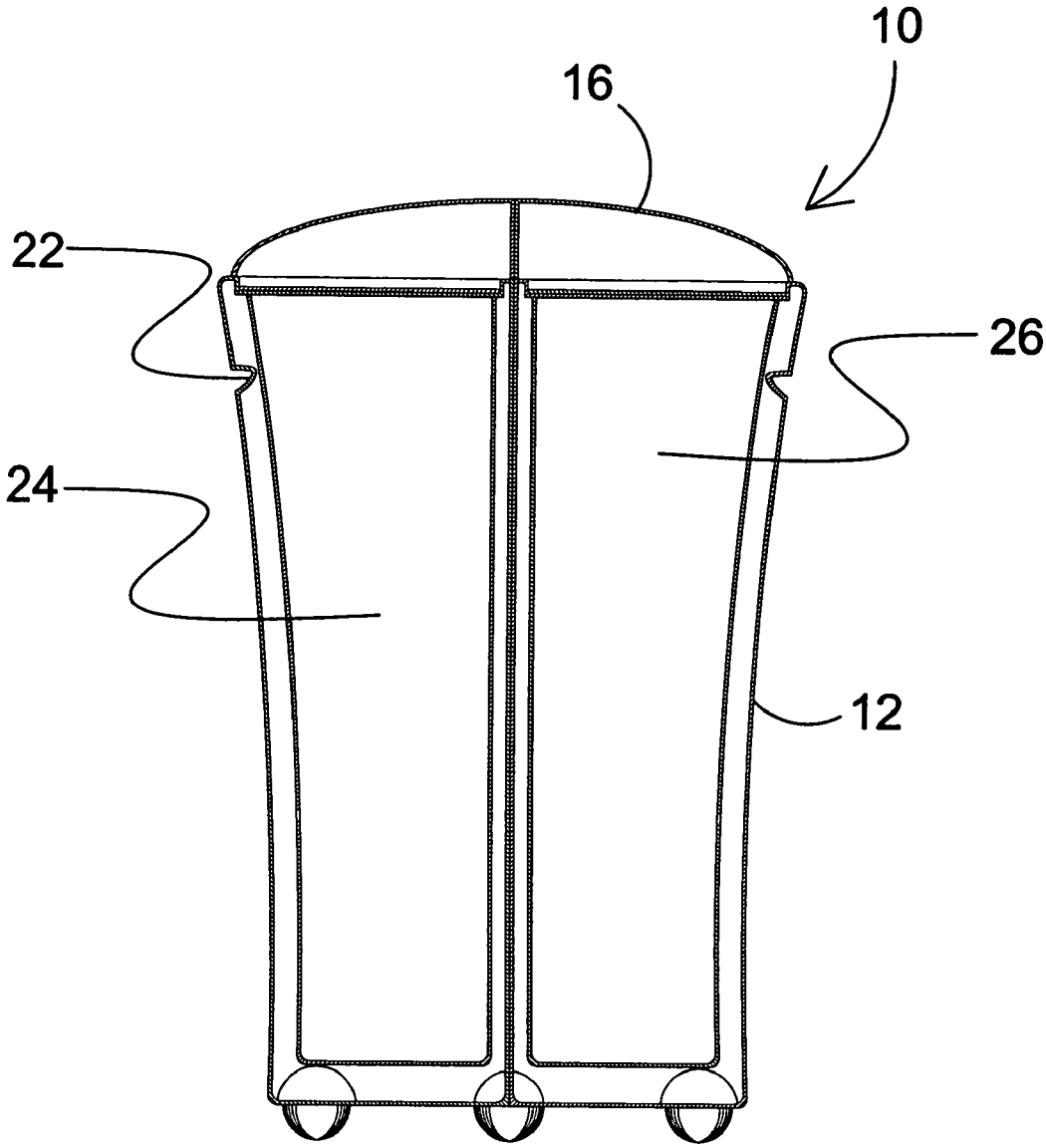
FIG. 3 is a cross sectional view of the present invention.

Turning to FIG. 3, shown therein is a cross sectional view of the present invention 10 wherein recyclable materials and trash are collected and sorted into two separate containers 24, 26, respectively. The containers 24, 26 are suspended inside the housing 12. Each container compartment 24, 26 in the housing 12 has an individual half lid 16. Each lid 16 may be raised and lowered independently. Handle 22 is also shown.

Figure 4:
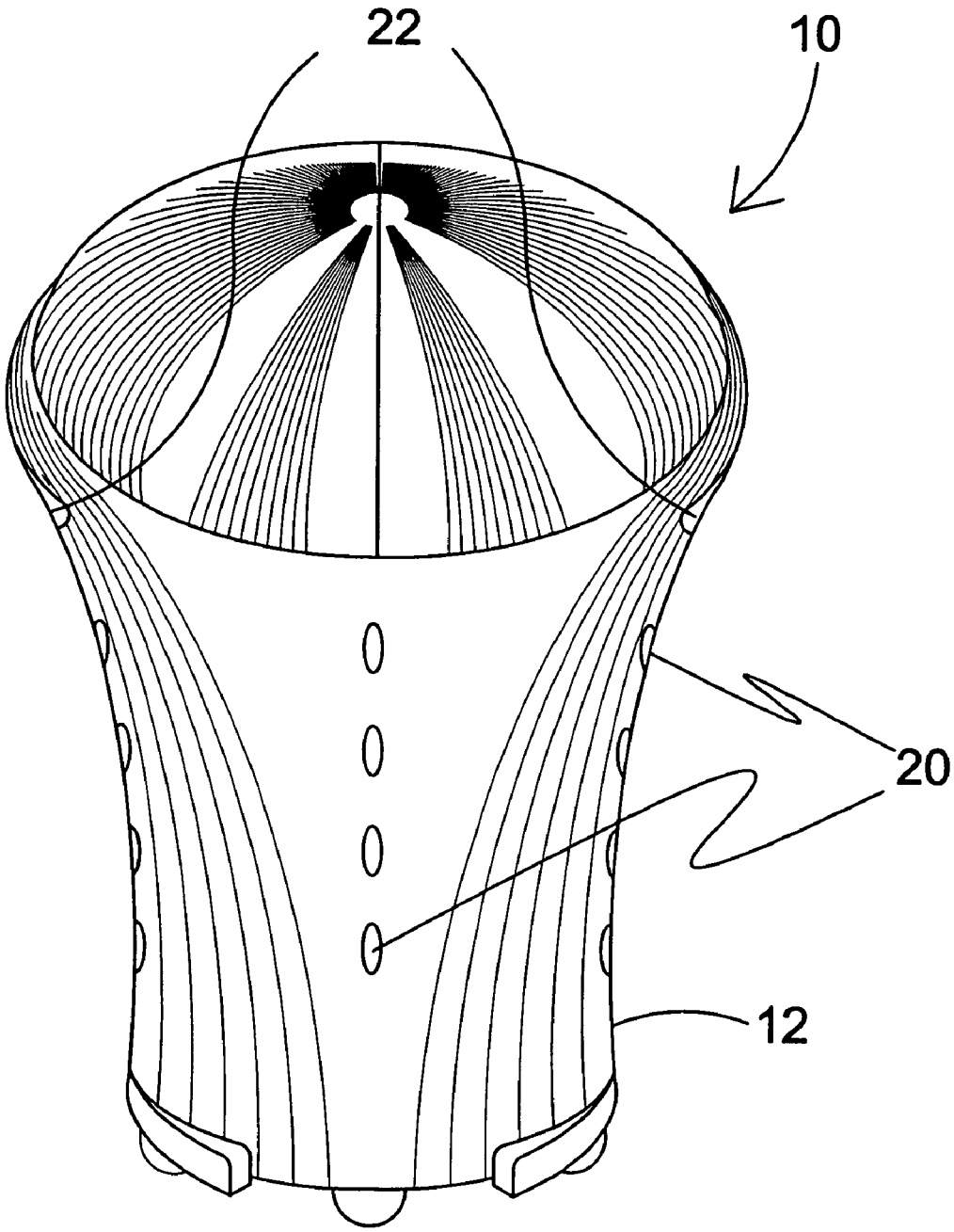
FIG. 4 is a perspective view of the present invention.

Turning to FIG. 4, shown therein is a perspective view of the present invention 10. The refuse collection device of the present invention 10 provides means for ventilation 20. The refuse collection device provides multiple orifices 20 in the housing 12 for ventilation of the individual container compartments. Handle 22 is also shown.

Figure 5:
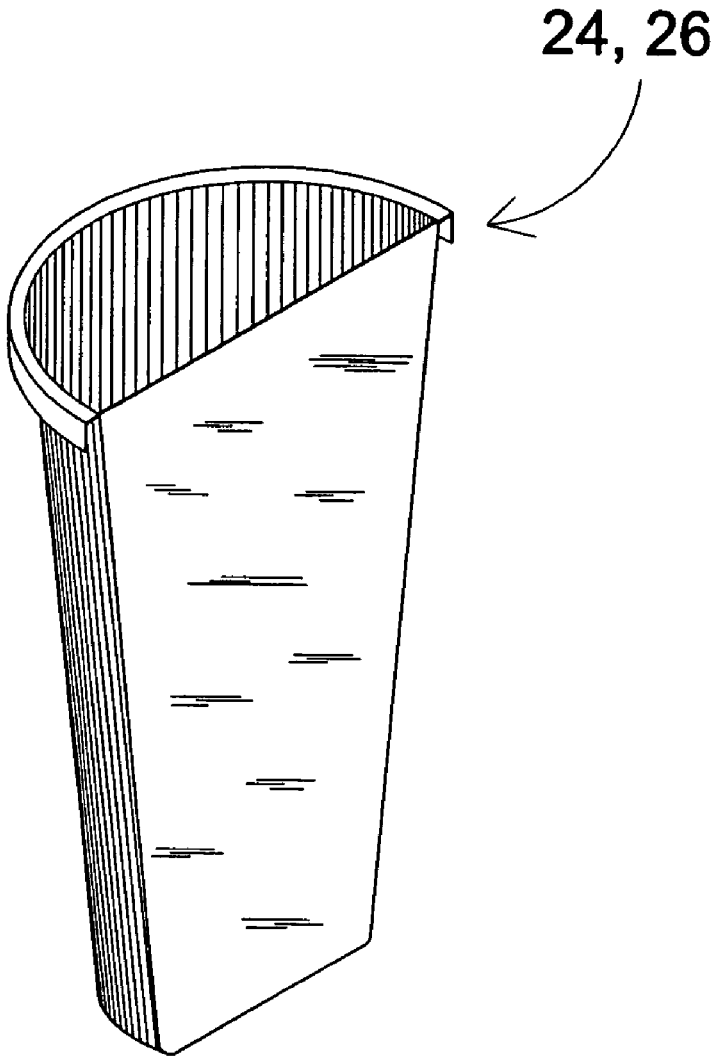
FIG. 5 is an isometric view of the present invention.

Turning to FIG. 5, shown therein 5 is an isometric view of the present invention. Depicted in FIG. 5 is one of the two individual containers 24, 26 that provide separate compartments for sorting refuse wherein each container has a horizontal cross-sectional area substantially in the shape of a half of a circle as shown.

Figure 6:
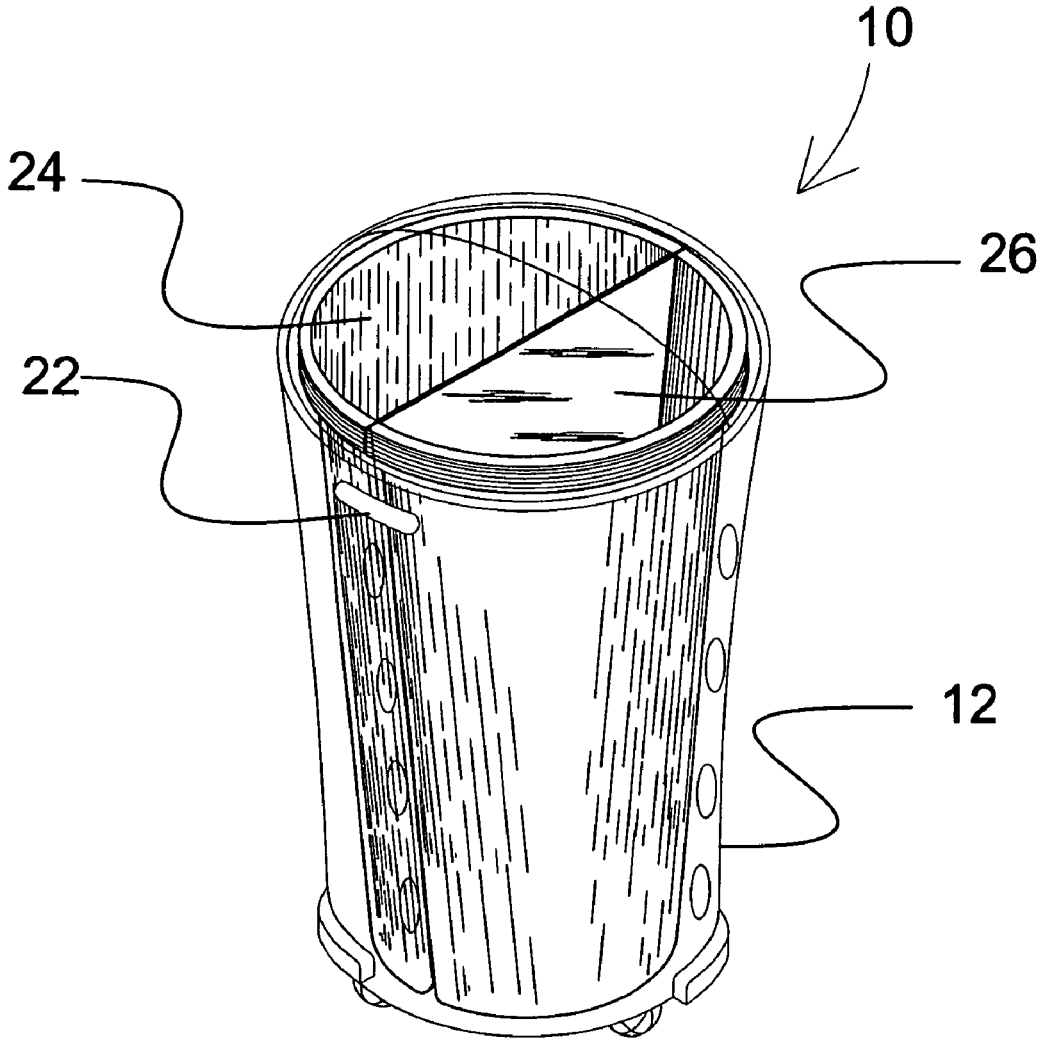
FIG. 6 is an isometric view of the present invention.

Turning to FIG. 6, shown therein is an isometric view of the present invention 10. Recyclable materials and trash are collected and sorted into two separate containers 24, 26, respectively. The containers 24, 26 are suspended inside the housing 12. Each container compartment 24, 26 in the housing 12 has an individual lid that is raised to access the container. Handle 22 is also shown.

Figure 7:
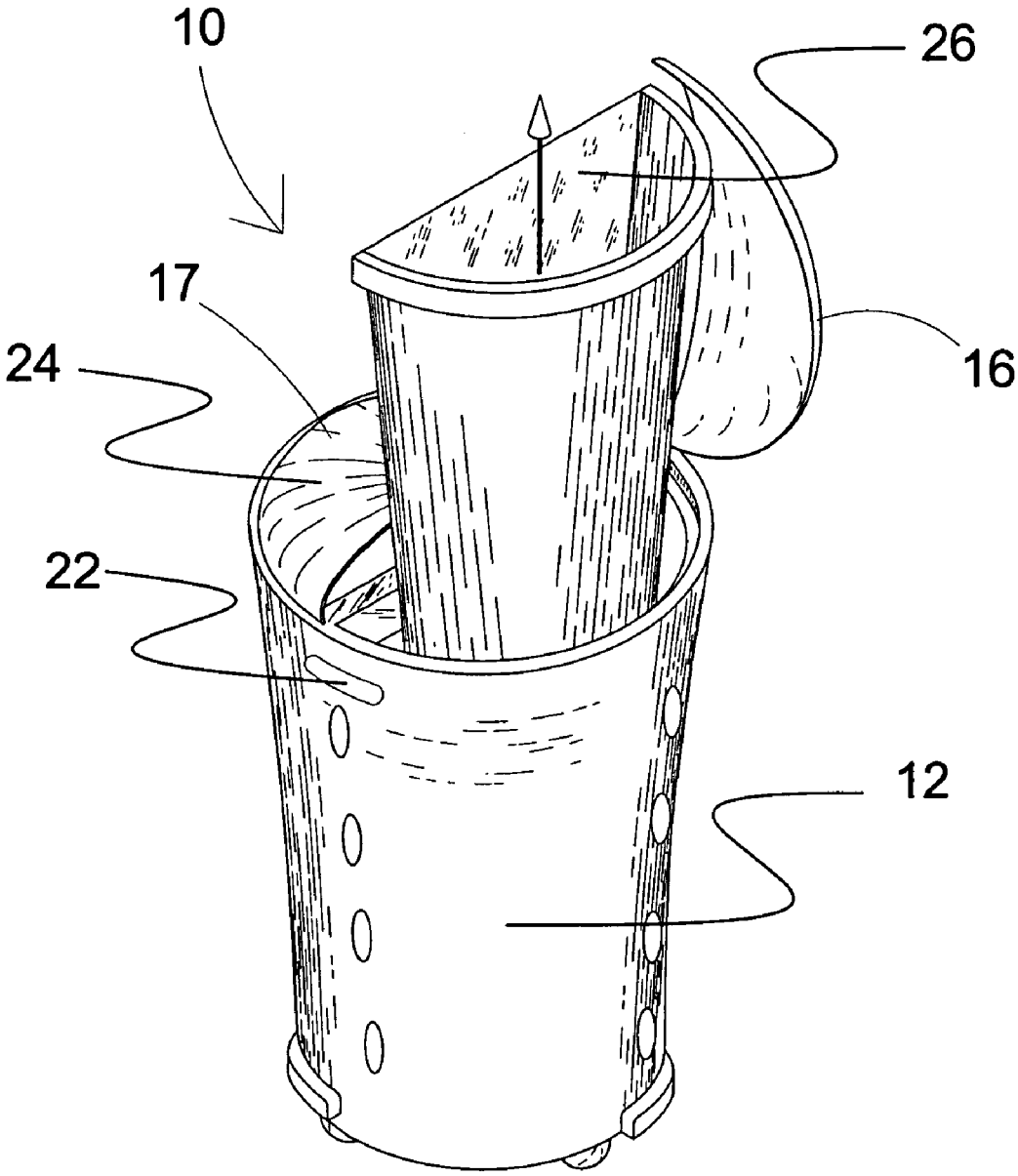
FIG. 7 is an isometric view of the present invention.

Turning to FIG. 7, shown therein is an isometric view of the present invention 10. The refuse collection device of the present invention 10 provides means to remove the containers individually. Each container compartment 24, 26 in the housing 12 has an individual lid 16, 17 that is raised to access the container. When the lid 16 is in a raised position, the compartment container 26 may be removed or inserted. Handle 22 is also shown.

Figure 8:
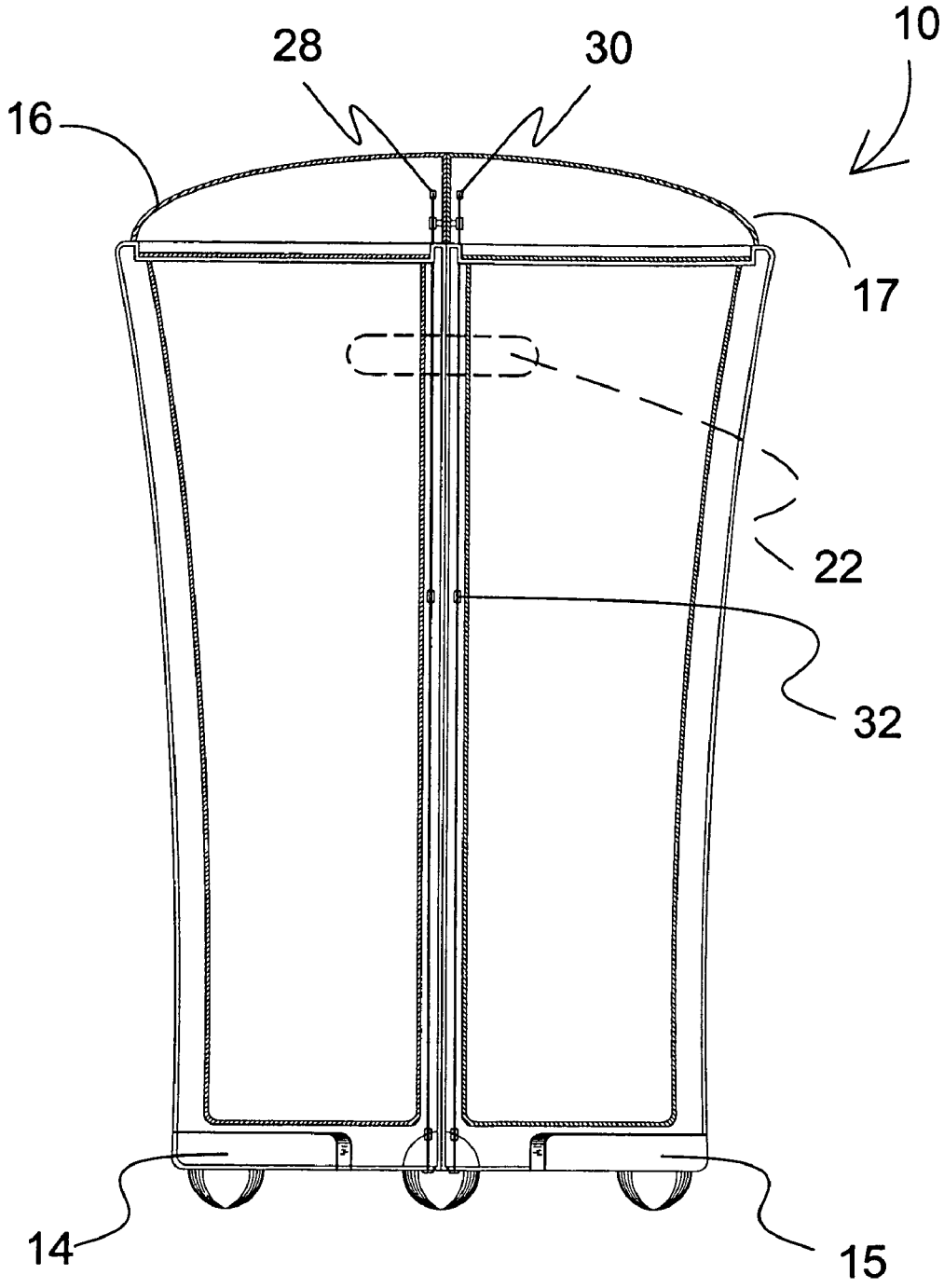
FIG. 8 is a sectional front view of the present invention.

Turning to FIG. 8, shown therein is a sectional front view of the present invention 10. Depicted in FIG. 8 is the refuse collect device 10 with the right 17 and left 16 side lids in a closed position. A pair of cable and guide lift assemblies 28, 30 interconnected between the left 14 and right 15 foot levers and lids 16, 17 provide means for the lids to be raised into an open position. Also shown are cable guide 32 and handle 22.

Figure 9:
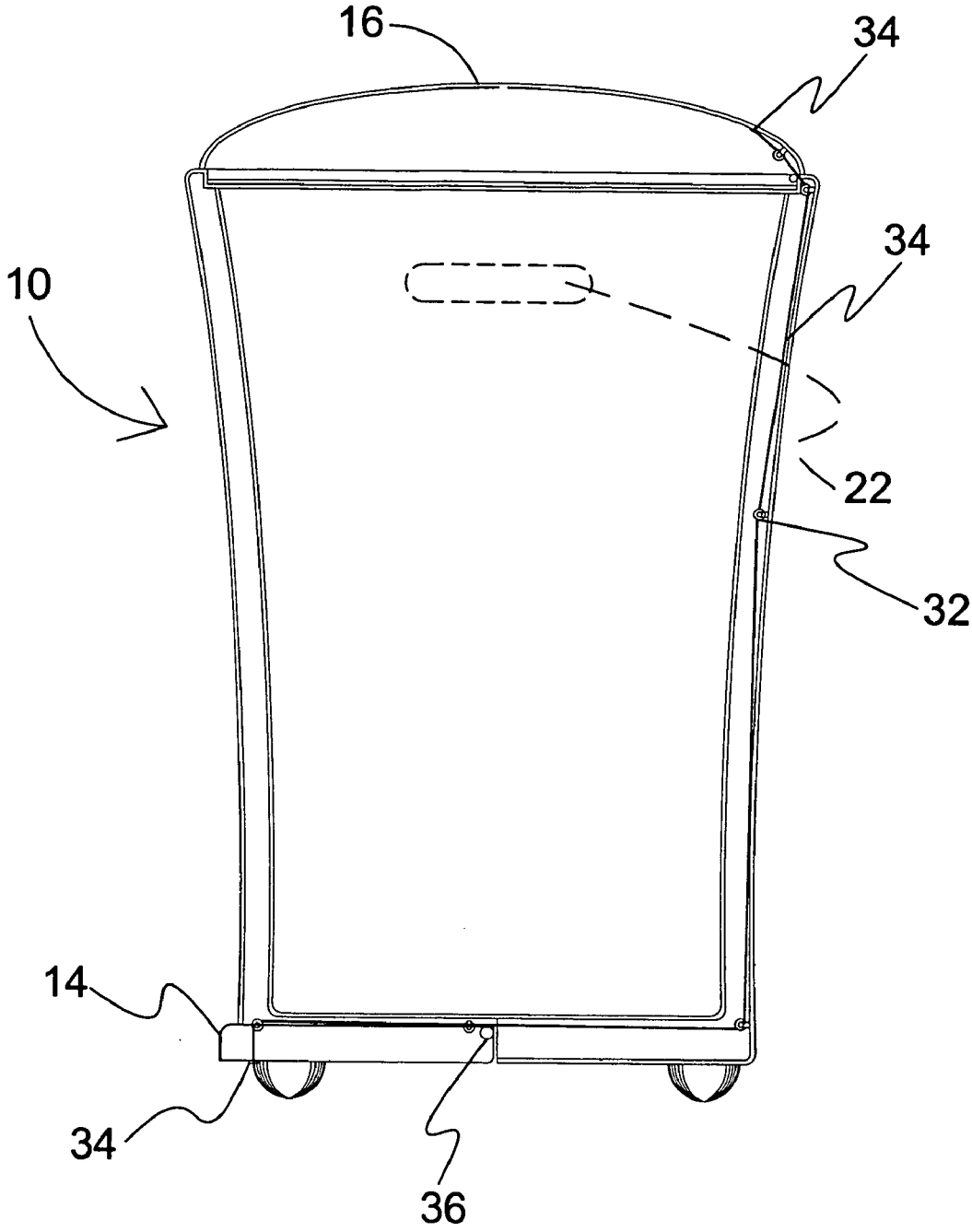
FIG. 9 is a sectional side view of the present invention.

Turning to FIG. 9, shown therein is a sectional side view of the present invention 10. Depicted in FIG. 9 is the refuse collect device with the right and left side lids 16, 17 in a closed position. A cable and guide assembly interconnected between the foot levers 14, 15 and lids 16, 17 provide means for the lids to be raised and lowered. On one end, the cable 34 is affixed to the foot lever 14 or 15 and on the opposite end the cable is affixed to the lid 16 or 17. A series of guides 32 between each end of the cable 34 support the cable movement from open and closed positions. Also shown are cable and anchors 36, foot lever pivot point or hinge 36 and handle 22.

Figure 10:
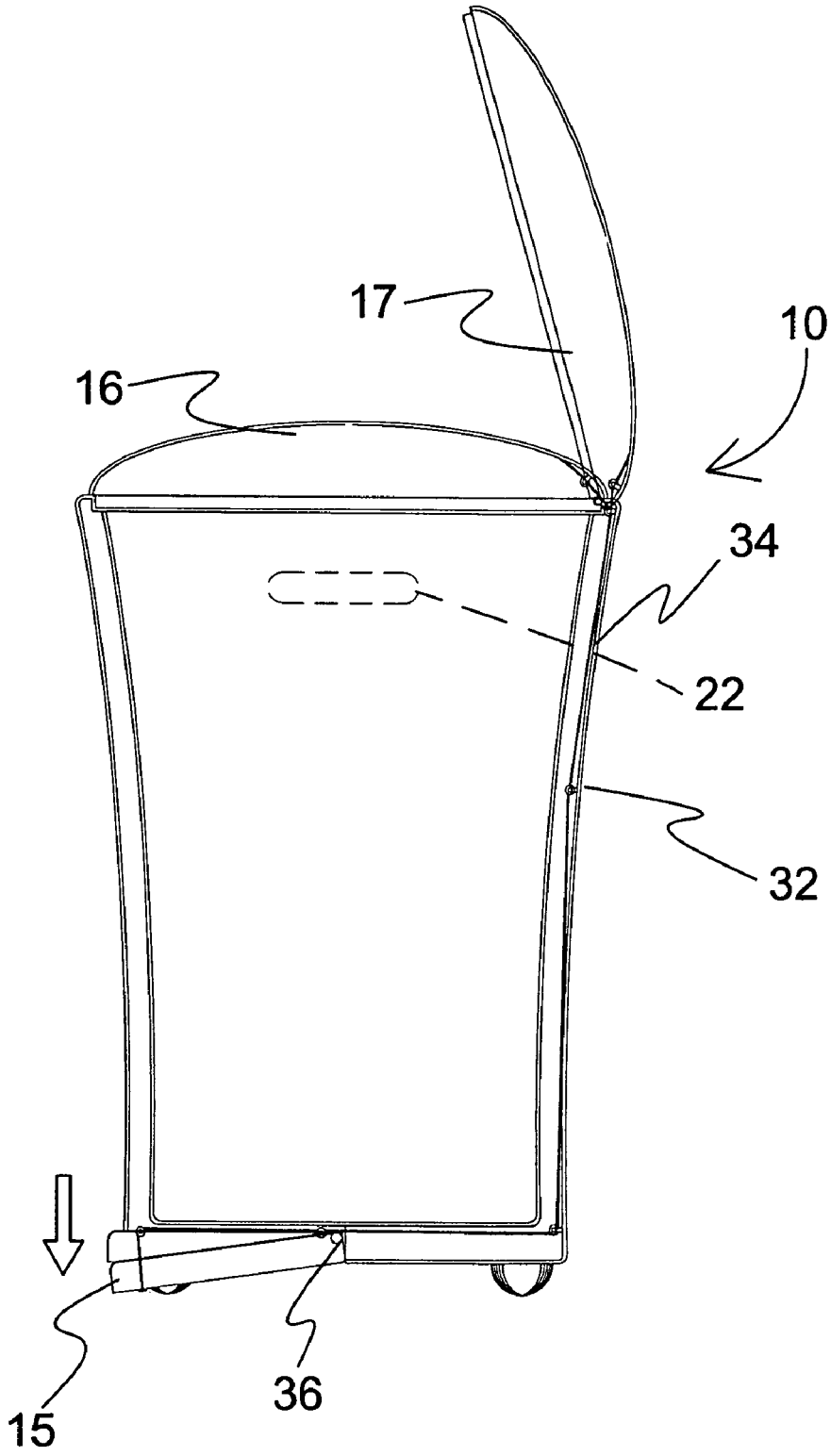
FIG. 10 is a sectional side view of the present invention.

Turning to FIG. 10 shown therein is a sectional side view of the present invention 10. Depicted in FIG. 10 is the refuse collect device with the right side lid 17 in an open position. When the right side foot lever 15 is pressed downward, the fixed length cable 34 is pulled in a downward direction causing the lid 17 to open. The lid 17 will close when the foot lever 15 is released by the user's foot. Also shown are foot lever hinge 36, cable guide 32 and handle 22.

Figure 11:
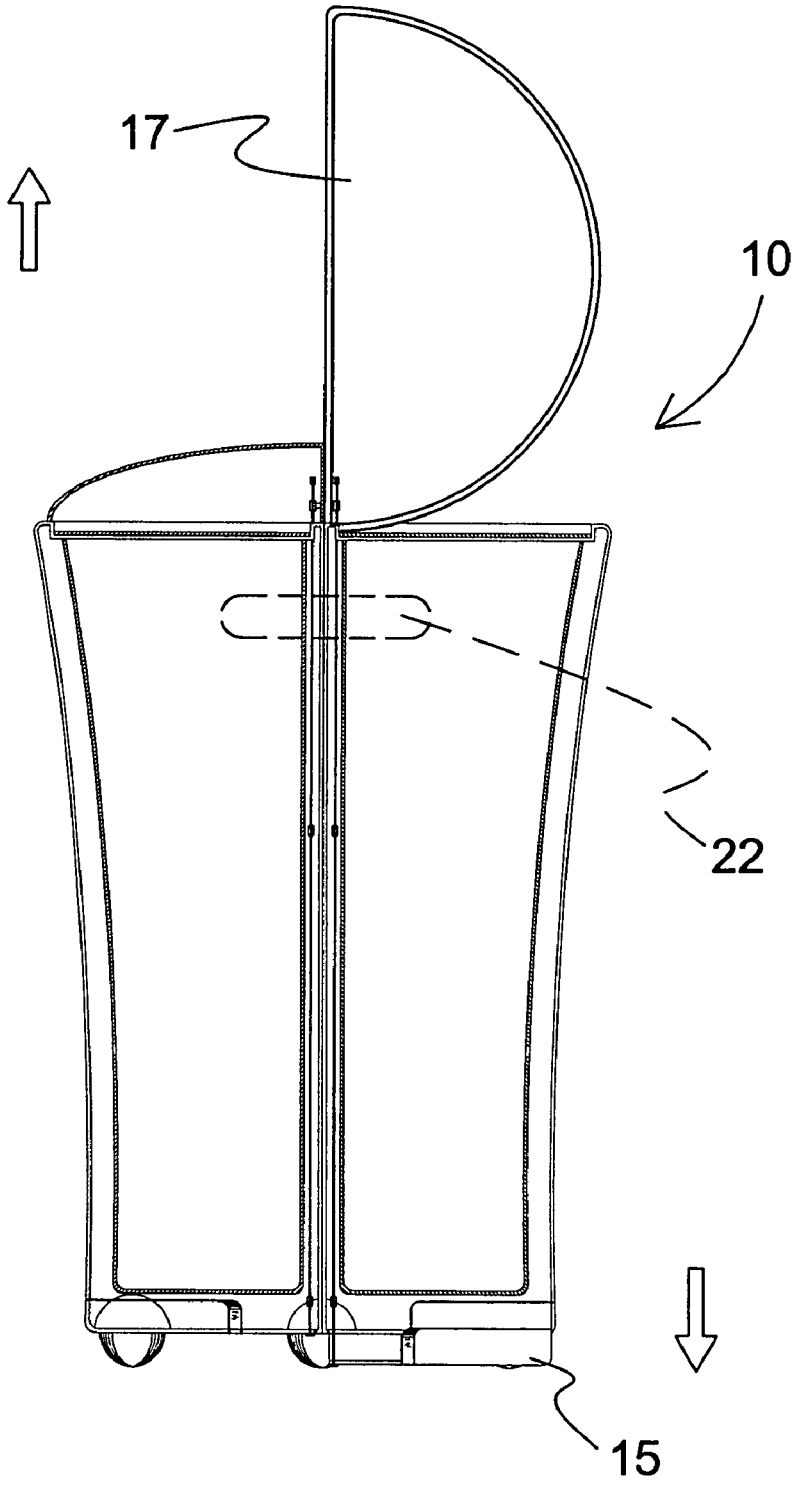
FIG. 11 is a sectional front view of the present invention.

Turning to FIG. 11, shown therein is a sectional front view of the present invention 10. Depicted in FIG. 11 is the refuse collect device 10 with the right side lid 17 in an open position. The right side lid 17 is opened when the corresponding right side lever 15 is engaged and pressed downward by the user's foot. A cable and guide assembly interconnected between the foot lever 15 and lid 17 provides means for the right side lid 16 to lift into an open position. The left side lid 16 is interconnected by a second cable and guide assembly that is independent from the right side cable assembly allowing each lid to open separately. Handle 22 is also shown.

Figure 12:
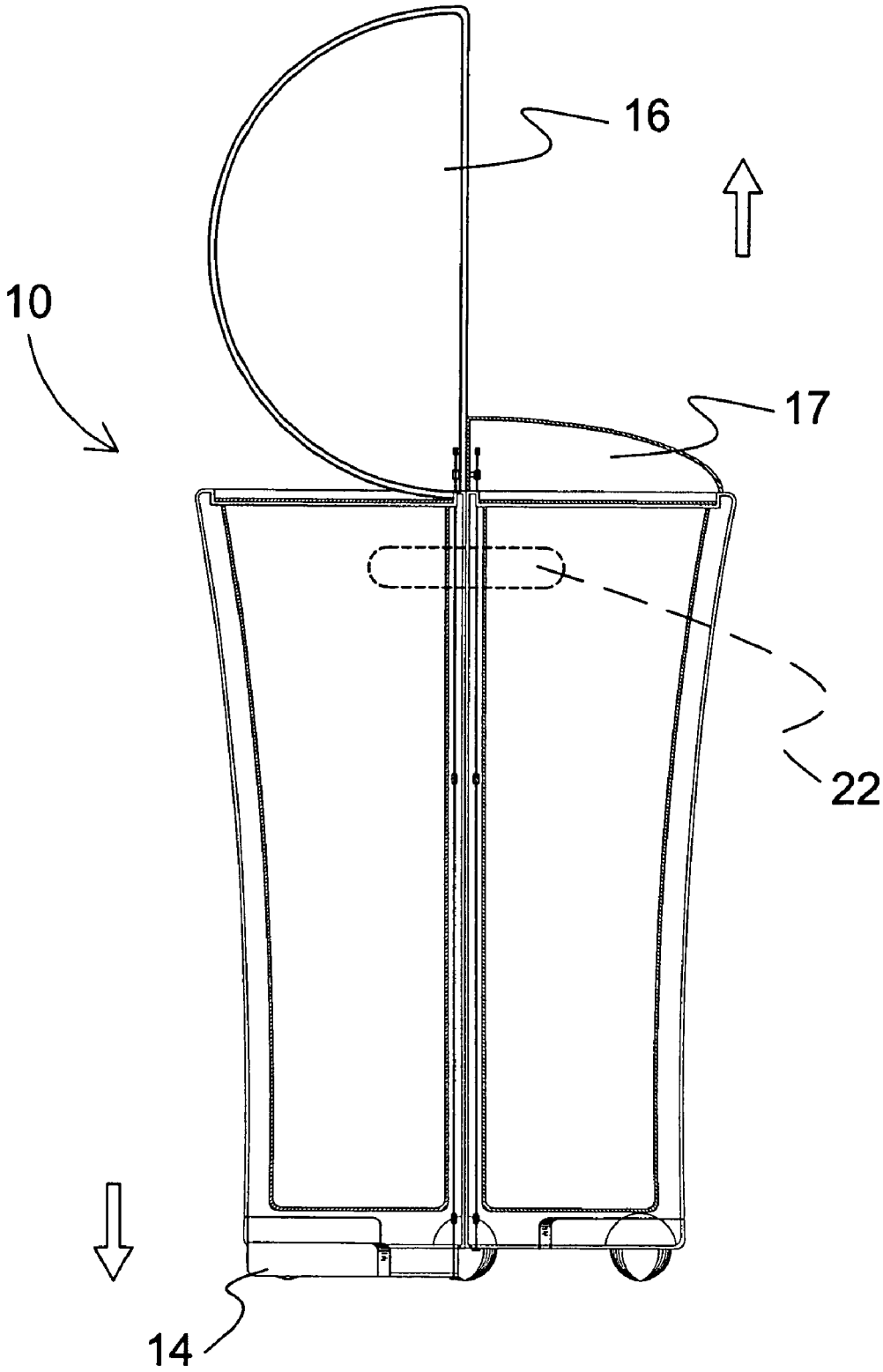
FIG. 12 is a sectional front view of the present invention.

Turning to FIG. 12, shown therein is a sectional front view of the present invention 10. Depicted in FIG. 12 is the refuse collect device 10 with the left side lid 16 in an open position. The left side lid 16 is opened when the left side foot lever 14 is engaged and pressed downward by the user's foot. A cable and guide assembly interconnected between the foot lever 14 and lid 16 provides means for the left side lid to lift into an open position. The right side lid 17 is interconnected by a second cable and guide assembly that is independent from the left side cable assembly allowing each lid to open separately. Handle 22 is also shown.

Figure 13:
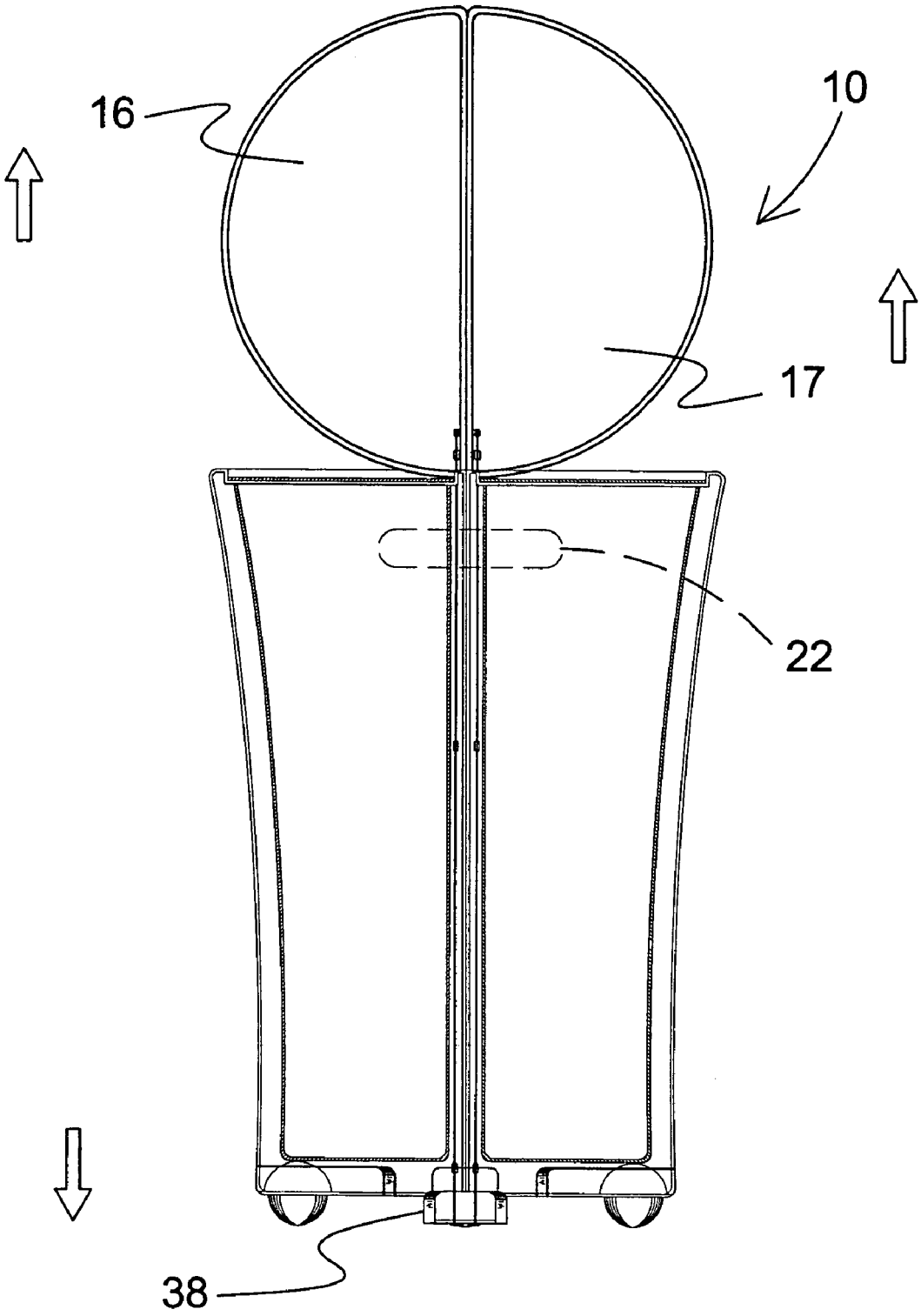
FIG. 13 is a sectional front view of the present invention with preferred element.

Turning to FIG. 13, shown therein is a sectional front view of the present invention 10 with preferred element. Depicted in FIG. 13 is the refuse collect device 10 with both the left 16 and right 17 side lids in an open position. In a preferred element of the present invention 10, the refuse collection device contains a third lever 38 to lift both lids 16, 17 together. When the third lever 38 is pressed downward by the user's foot, both the right and left side cable and guide assemblies are engaged allowing both lids 16, 17 to open. Handle 22 is also shown.

I claim:

1. An apparatus for providing a compartmentalized receptacle for trash and recyclables, comprising:

a) a housing having a cylindrical shape, said housing being substantially upright standing, said housing having top and bottom ends, wherein said top end is open, said housing having a wall;

b) first and second containers being removably disposed in said housing, each of said containers having a top and bottom, wherein each of said top ends of said containers are open, wherein each of said containers is shaped in horizontal cross-section substantially like a half circle, wherein said first container is for receiving trash and said second container is for receiving recylables;

c) first and second lids being disposed side by side on said top end of said housing to permit a user to access the first and second containers, wherein said first lid is complementarily shaped in a half circle cross-section as said top end of said first container and said second lid is complementarily shaped in a half circle cross-section as said top end of said second container, each lid being hinged in one corner thereof, wherein each of said first and second lids is closed in a first position and pivoted upwardly around said hinge to be open in a second position;

d) structure for operating said first and second lids whereby the user can move each of the first and second lids back and forth between the closed position and the open position comprising:

i) wherein each said first and second lids are hinged side by side to said top of said wall of said housing so that said lids can pivot between said closed position and said open position;

ii) first and second foot levers being disposed on said bottom of said housing so that said first and second foot levers operate said first and second lids, respectively, said foot levers being spaced apart with a portion of curvature of said housing separating said foot levers;

iii) first and second cables each having first and second ends, wherein said first end of each said first and second cables connects to said first and second foot levers, respectively, and, wherein said second end of each said first and second cable connects to said first and second lids, respectively, so that when said first foot lever is depressed by the foot of a user said first lid moves from said closed to said open position and when said second foot lever is depressed by the foot of a user said second lid moves from said closed to said open position, wherein when said foot levers are released said lids return to their closed positions position; and iv) a plurality of guides being disposed in a spaced apart manner along said first and second cables so as to affix said cables to the inside of the wall of said housing; and e) a third foot lever directly under said side by side hinges for raising said first and second lids simultaneously from the closed position to the open position.

2. The apparatus of claim 1, further comprising a plurality of wheels being disposed on said bottom of said housing to permit the housing to be rolled about on a surface.

3. The apparatus of claim 2, wherein the walls of the housing have a plurality of holes therein, wherein said vent holes provide ventilation to the inside of said housing.

4. The apparatus of claim 3, further comprising a plurality of handles being disposed on said top of said housing to permit a user to handle the housing.

5. The apparatus of claim 4, wherein said handles are embedded into the walls of the housing so that said handles are recessed in the walls of the housing.

6. The apparatus of claim 5, wherein said first foot lever operates independently of said second foot lever.

* * * * *